US006988584B2

(12) United States Patent
Takahashi et al.

(10) Patent No.: US 6,988,584 B2
(45) Date of Patent: Jan. 24, 2006

(54) SPEAKER DIAPHRAGM EDGE AND ITS MANUFACTURING METHOD

(75) Inventors: Yoshiyuki Takahashi, Matsusaka (JP); Shinya Tabata, Mie (JP); Shinya Mizone, Tsu (JP); Toshihiro Shimizu, Matsusaka (JP); Yukio Sone, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/441,861

(22) Filed: May 19, 2003

(65) Prior Publication Data

US 2004/0026164 A1 Feb. 12, 2004

(30) Foreign Application Priority Data

May 20, 2002 (JP) ..... 2002-145090

(51) Int. Cl.
*H04R 7/02* (2006.01)

(52) U.S. Cl. ..... 181/171; 181/172; 381/386; 381/392

(58) Field of Classification Search ..... 181/169–172, 181/167; 381/386, 392, 426, 428; 101/122, 101/128.1, 128.4, 129
See application file for complete search history.

(56) References Cited

U.S. PATENT DOCUMENTS

| | | | | | |
|---|---|---|---|---|---|
| 4,202,663 | A | * | 5/1980 | Haigh et al. | 101/464 |
| 4,409,893 | A | * | 10/1983 | Newman et al. | 101/129 |
| 5,080,743 | A | * | 1/1992 | Odajima | 181/169 |
| 6,378,649 | B1 | * | 4/2002 | Inoue et al. | 181/167 |
| 2003/0188919 | A1 | * | 10/2003 | Suzuki et al. | 181/171 |

FOREIGN PATENT DOCUMENTS

| | | | |
|---|---|---|---|
| JP | 57002192 | A * | 1/1982 |
| JP | 57087696 | A * | 6/1982 |
| JP | 57180298 | A * | 11/1982 |
| JP | 58130697 | A * | 8/1983 |
| JP | 59135998 | A * | 8/1984 |
| JP | 60087087 | A * | 5/1985 |
| JP | 61016698 | A * | 1/1986 |
| JP | 01029197 | A * | 1/1989 |
| JP | 64000896 | A * | 1/1989 |
| JP | 01270491 | A * | 10/1989 |
| JP | 8-19092 | | 1/1996 |
| JP | 11-308693 | | 11/1999 |
| JP | 2001-197590 | | 7/2001 |

* cited by examiner

*Primary Examiner*—Edgardo San Martin
(74) *Attorney, Agent, or Firm*—Jordan and Hamburg LLP

(57) ABSTRACT

A speaker diaphragm edge obtained by hot-forming into a desired edge shape, a resin-treated base material, which was prepared by using a silkscreen printing technique to apply a shaping agent layer only to the necessary portion of a base material.

7 Claims, 6 Drawing Sheets

PRIOR ART

PRIOR ART

SPEAKER DIAPHRAGM EDGE AND ITS MANUFACTURING METHOD

BACKGROUND OF THE INVENTION

The present invention relates to a speaker diaphragm edge such that an unprecedented new material is used and it is formed and finished precisely and correctly by means of a skillful processing method, and relates to its manufacturing method.

In brief, the structure of the general speaker shown in FIG. 1 is such that the speaker shown in the same figure is an electrodynamic-type speaker with a commonly known structure. 1 indicates the speaker proper. 2 is the magnetic circuit that contains magnet 2*a* and is held and attached to the base of the frame 7. 3 is the voice coil, which is suspended so as not to contact the magnetic domain wall within the toroidal magnetic gap 2*b* of the aforementioned magnetic circuit 2. Also, the tip center part of the truncated-conical diaphragm 5 is adhered and attached to the tip of the voice coil bobbin 3*a*. The damper 4 connects the tip center part of the diaphragm 5 and the frame 7. Also, the diaphragm edge 6 connects the periphery of the diaphragm 5 and the outer edge of the frame 7. Both the damper 4 and the diaphragm edge 6 are compliant in the direction of the principal axis of the speaker 1, and the diaphragm 5 and the voice coil 3 are held vibratably within the frame 7. When audio current flows in the voice coil 3, the aforementioned audio current and the magnetic flux within the toroidal magnetic gap 2*b* interlink and a driving force is generated, thereby vibrating the diaphragm 5, causing it to emit sound waves.

At its inner and outer peripheries, the diaphragm edge 6 is composed, respectively, of the inner attachment margin 6*a* that is adhered to the outer periphery of the diaphragm 5 and the outer attachment margin 6*c* that is adhered to the outer edge of the frame 7. Between them is formed the toroidal flexible part 6*b* that vibratably supports both the damper 4 and the diaphragm 5 and is compliant with respect to the displacement along the principal axis. In the speaker assembly process, the diaphragm 5, voice coil 3, damper 4, and edge 6 normally are manufactured as a single member, and the diaphragm 5 and diaphragm edge 6 are united by adhering the outer periphery of the diaphragm 5 and the inner attachment margin 6*a* of the diaphragm edge 6, in the preproduction process. The outer edge of the frame 7 and the outer attachment margin 6*c* of the diaphragm edge 6 are adhered in the speaker 1 assembly process.

Regarding the speaker diaphragm edge 6, whose shape is shown in FIG. 2, the diaphragm edge is conventionally made by impregnating the rolled base fabric 10 with a phenolic resin or a melaminic resin as the shaping agent, and the front and back are coated with a resonance inhibitor and a filler that prevents the leakage of air, and this is hot-pressed in a mold to form the specified shape. In some cases, the filler and resonance inhibitor are applied after the specified shape is formed. In a conventional diaphragm edge 6 with such a structure, the entire base fabric is impregnated with a shaping agent, so a large quantity of the aforementioned shaping agent is required. The punching slugs after punching to the final shape contain the shaping agent, so there are problems with the cost and trouble of disposal. Also, phenolic resin and melaminic resin are thermosetting resins and are very hard after molding, so it is necessary to dilute the concentration of impregnated resin solution, to obtain the flexibility required by the edge. Therefore, its strength is inadequate, so the life of its preferred state is short. Another drawback is that the speaker performance deteriorates as a result of the nonuniformity of the applied film and the impregnation state.

SUMMARY OF THE INVENTION

Applicants formerly adopted the silkscreen printing technique for not only the shaping agent but also for the filler, resonance inhibitor, etc., thereby improving the uniformity of coated films, saving weight by reducing the coated amount, and improving the speaker performance and economy, which eliminated the drawbacks of conventional edges. However, during the development of the present invention, a shaping agent and other agents are applied to the entire base fabric, so naturally there is a limit to the reduction of the amount shaping agent used. This time, therefore, the applicants developed a speaker diaphragm edge adequate to solve the aforementioned problems and its manufacturing method as follows: to minimize the amount of this shaping agent used and to further improve the speaker performance and economy, they took advantage of the features of the silkscreen printing technique and, as shown in FIG. 5, applied the shaping agent only to the necessary portion of the base fabric 10, investigated the materials of the shaping agent, and extended this technique to the application of the filler and the resonance inhibitor.

DESCRIPTION OF THE PREFERRED EMBODIMENTS

Figure 1:
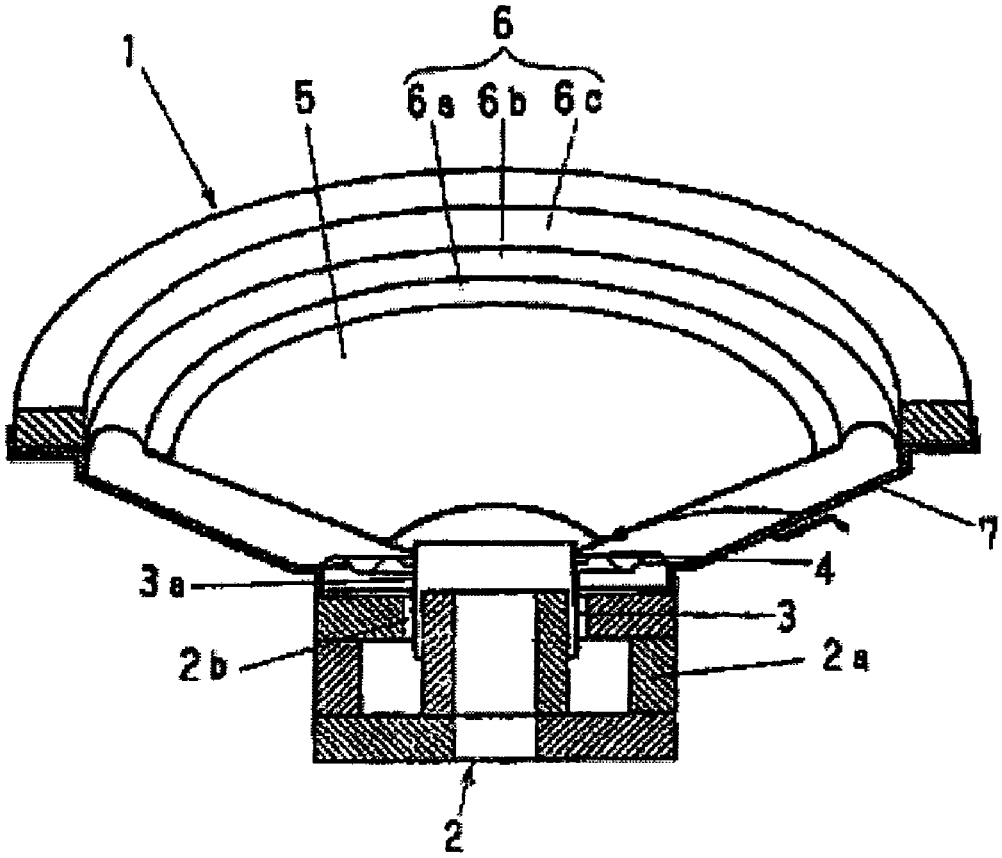
FIG. 1 is a cross-sectional oblique view showing the structure of a general electrodynamic-type speaker.

The previously explained structures of the invention of the present application will be explained next, with reference to the symbols used in the drawings. A first aspect of the present application is a speaker diaphragm edge obtained by hot-forming, into the desired edge shape, a resin-treated base material 11, which was prepared by using a silkscreen printing technique to apply the shaping agent layer 17 only to the necessary portion of a base fabric 10.

A second aspect is a speaker diaphragm edge obtained by hot-forming, into the desired edge shape, the resin-treated base material 11, which was prepared by using a silkscreen printing technique to apply the shaping agent layer 17 only to the necessary portion of the base fabric 10 and by then applying the hot-melt adhesive 14 to the area of bonding between the diaphragm 5 and frame 7.

A third aspect is a speaker diaphragm edge obtained by hot-forming, into the desired edge shape, the resin-treated base material 11, which was prepared by using a silkscreen printing technique to apply the shaping agent layer 17 only to the necessary portion of the base fabric 10, after which the surface coating agent layer 12 was formed on its surface, to improve the physical functionality of the diaphragm edge.

A fourth aspect is a speaker diaphragm edge obtained by further forming the surface coating agent layer 12, which is designed to improve the physical functionality of the diaphragm edge, on the surface of the resin-treated base material 11, which was prepared by using a silkscreen printing technique to apply the shaping agent layer 17 only to the necessary portion of the base fabric 10, and by then hot-forming to the desired edge shape.

A fifth aspect is a speaker diaphragm edge manufacturing method composed of a process whereby the resin-treated base material 11 is formed by using a silkscreen printing technique to apply a shaping agent only to the necessary portion of the base fabric 10, thereby forming the shaping agent layer 17; a process whereby the aforementioned resin-treated base material 11 is hot-formed so that the edge's flexible part 6*b* assumes the desired shape; and a process whereby the hot-formed resin-treated base material 11 is cut into ring shapes that conform to the peripheries of the desired diaphragms.

A sixth aspect is a speaker diaphragm edge manufacturing method composed of a process whereby the resin-treated base material 11 is formed by using a silkscreen printing technique to apply a shaping agent only to the necessary portion of the base fabric 10, thereby forming the shaping agent layer 17; a process whereby the aforementioned resin-treated base material 11 is hot-formed so that the edge's flexible part 6*b* assumes the desired shape; a process whereby the hot-formed resin-treated base material 11 is cut into desired ring shapes that conform to the periphery of the diaphragm; and a process whereby the hot-melt adhesive 14 is applied to the area of bonding between the peripheral diaphragm 5 and the frame 7, within the edge material cut into ring shapes.

A seventh aspect is a speaker diaphragm edge manufacturing method composed of a process whereby the resin-treated base material 11 is formed by using a silkscreen printing technique to apply a shaping agent only to the necessary portion of the base fabric 10, thereby forming the shaping agent layer 17; a process whereby the aforementioned resin-treated base material 11 is hot-formed into the specified shape; a process whereby the surface coating agent layer 12 is applied and formed at desired locations on the formed surface; and a process whereby the coated base material is cut into rings corresponding to the circumferential shapes of the desired diaphragms.

An eighth aspect is a speaker diaphragm edge manufacturing method composed of a process whereby the resin-treated base material 11 is formed by using a silkscreen printing technique to apply a shaping agent only to the necessary portion of the base fabric 10, thereby forming the shaping agent layer 17; a process whereby the surface coating agent layer 12 is applied and formed at desired locations on the aforementioned resin-treated base material 11; a process whereby the coated base material is heat-treated and formed into the desired shape; and next a process whereby the coated base material is cut into rings corresponding to the circumferential shapes of the desired diaphragms.

During the implementation of each of the aforementioned, the base fabric 10 generally is a woven fabric (e.g., cotton cloth, silk cloth). However, it also may be a nonwoven fabric composed of a synthetic fiber or an elastic woven fabric made of one type of raw thread. In nonwoven fabric or elastic woven fabric, there is no obvious orientation in the fiber alignment, so its characteristics are conducive to a flexible and homogeneous material. The shaping agent also may be a thermosetting resin, such as a phenolic resin, a melaminic resin, an epoxy resin, a silicon resin, etc. However, it also may be an elastomer or a resin composite made flexible by blending polyvinyl alcohol or another alcohol resin into these thermosetting resins (e.g., phenolic resin). When these thermosetting resins or thermosetting resin composites are used as the shaping agent, it has the following effects: the material becomes flexible and the solute permeability is improved; the application of the silkscreen printing technique is facilitated; the coating accuracy and appearance are improved; it resists destruction caused by deformation resulting from repeated displacement during operation of the diaphragm 5, thereby extending the life of the speaker; and it deforms reasonably in response to displacement, thereby improving the linearity, which decreases nonlinear distortion of played-back sounds.

Furthermore, the surface coating agent layer 12, which is designed to improve its physical functionality, is formed on the diaphragm edge. Requested physical functions include (1) the function of a filler that maintains the airtightness of the edge between the front and rear of the diaphragm; (2) the function that, by providing mechanical internal loss in response to vibration, inhibits edge and diaphragm resonance, thereby preventing speaker sound quality degradation; (3) the function that maintains long-term speaker quality by improving its weather resistance; etc. However, multiple layers of material having one of the aforementioned functions may be formed as the surface coating agent layer 12, but a layer of material having all functions also may be provided. A synthetic rubber emulsion coating, etc., may be utilized as such a material. Also, examples of a 1-liquid paint having only functions as the surface coating agent layer 12 include a methacrylic resin coating containing an admixed plasticizer and an emulsion coating of a plasticizer-admixed methacrylic resin with a water-based solvent. Such a surface coating agent layer 12 may also be coated by means of the silkscreen printing technique, as in the case of the shaping agent, or it may also be coated in multiple layers together with the shaping agent, by means of a series of processes. Or it also may be coated by another means after edge shape formation.

The resin-treated base material 11 resulting from coating is heated and pressurized by means of a mold heated to the temperature appropriate to the used surface coating agent as well as the shaping agent, thereby forming the diaphragm edge 6 having the specified shape. Regarding the edge's flexible part 6*b*, the roll edge, which has a circular arc-shaped cross-section in the speaker's radial direction and is convex at the front, is shown in the embodiment drawings. However, the present invention is not limited to this shape, and it goes without saying that it also may be an edge called a corrugation or an edge with another shape (e.g., an edge formed by circumferentially juxtaposing telescoping pleats like a snake's abdomen).

Embodiments of the manufacturing methods of the aforementioned aspects 5–8 will be explained next. The mask 29 that overlays the silkscreen 28 and specifies the regions to be coated is placed in contact with the base fabric 10, and the shaping agent layer 17 is formed (see FIG. 4) on the surface of the base fabric 10 by applying the shaping agent via the silkscreen 28 only to the necessary regions masked by the mask 29, thereby creating the resin-treated base material 11. Furthermore, in the coating processes for this shaping agent and surface coating agent, it overlaps the silkscreen 28 and the mask 29, and by using silkscreens with different meshes and masks with different patterns, multiple layers of different or equivalent surface coating agents and shaping agents are applied, thereby enabling the improvement of speaker performance by varying the edge properties in response to local changes in diaphragm rigidity. When the silkscreen printing technique is used to form the aforementioned multilayer coating as well as the surface coating agent layer 12 and even the hot-melt adhesive layer 14, the number of slaved process sections, each of which is composed of the silkscreen 28, the mask 29, and the drying heater 27 and are depicted as coating unit 20, is according to the number of layers. For the shaping agent or the surface coating agent, the commercial value can be increased by coloring, as required, with a dye or pigment appropriate to their respective material.

Regarding the diaphragm edge created as aforementioned, when a shaping agent or surface coating agent is applied, the coating layer thickness can be specified by selecting the mesh of the silkscreen 28, and the coating region can be defined by specifying the pattern of mask 29. Therefore, coatings do not reach the regions to be discarded after completion, making this process economical. Also, when necessary, if the coating operations used for the shaping agent and the surface coating agent are performed in one step, the reduced amount of work further improves the economic efficiency. Furthermore, by selecting the material of the shaping agent or the surface coating agent, it is possible to freely and highly reproducibly achieve the desired values of mechanical internal loss and compliance with respect to the resonance and vibrational displacement of the diaphragm edge 6. Also, the silkscreen printing technique is used to form the shaping agent layer or the surface coating layer, so compared with conventional cases impregnated with a shaping agent, etc., less coating is applied and the edge of the completed produced is uniform and lightweight. Therefore, speakers that utilize the diaphragm edge of the present invention have a high electroacoustic transduction efficiency and the vibration state is stable, and there is little adverse effect on the diaphragm, so this acts to improve the speaker performance over the entire spectrum. Furthermore, as mentioned previously, this has the effects of improving both the economy during production and the commercial value of the speaker.

Figure 2:
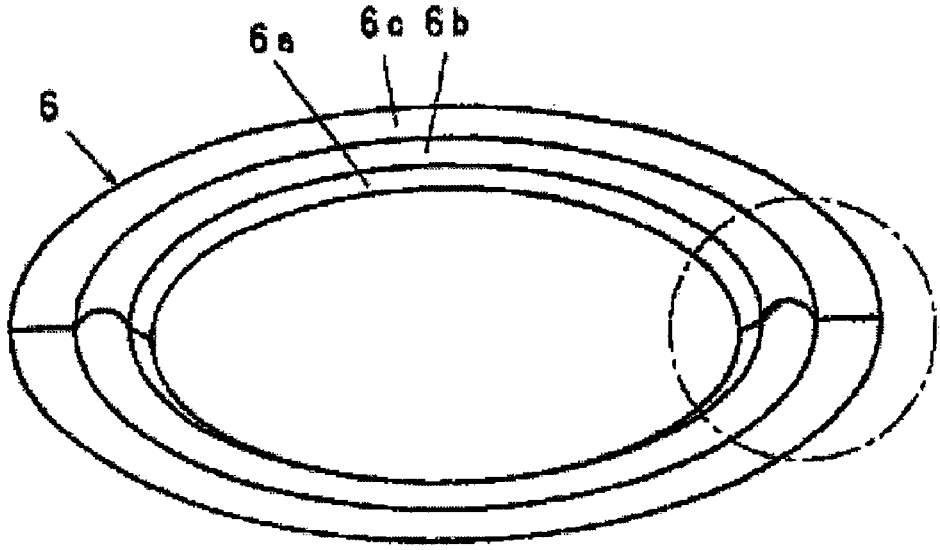
FIG. 2 is an oblique outline view of the diaphragm edge of Embodiment 1, in the speaker of FIG. 1.
Figure 3:
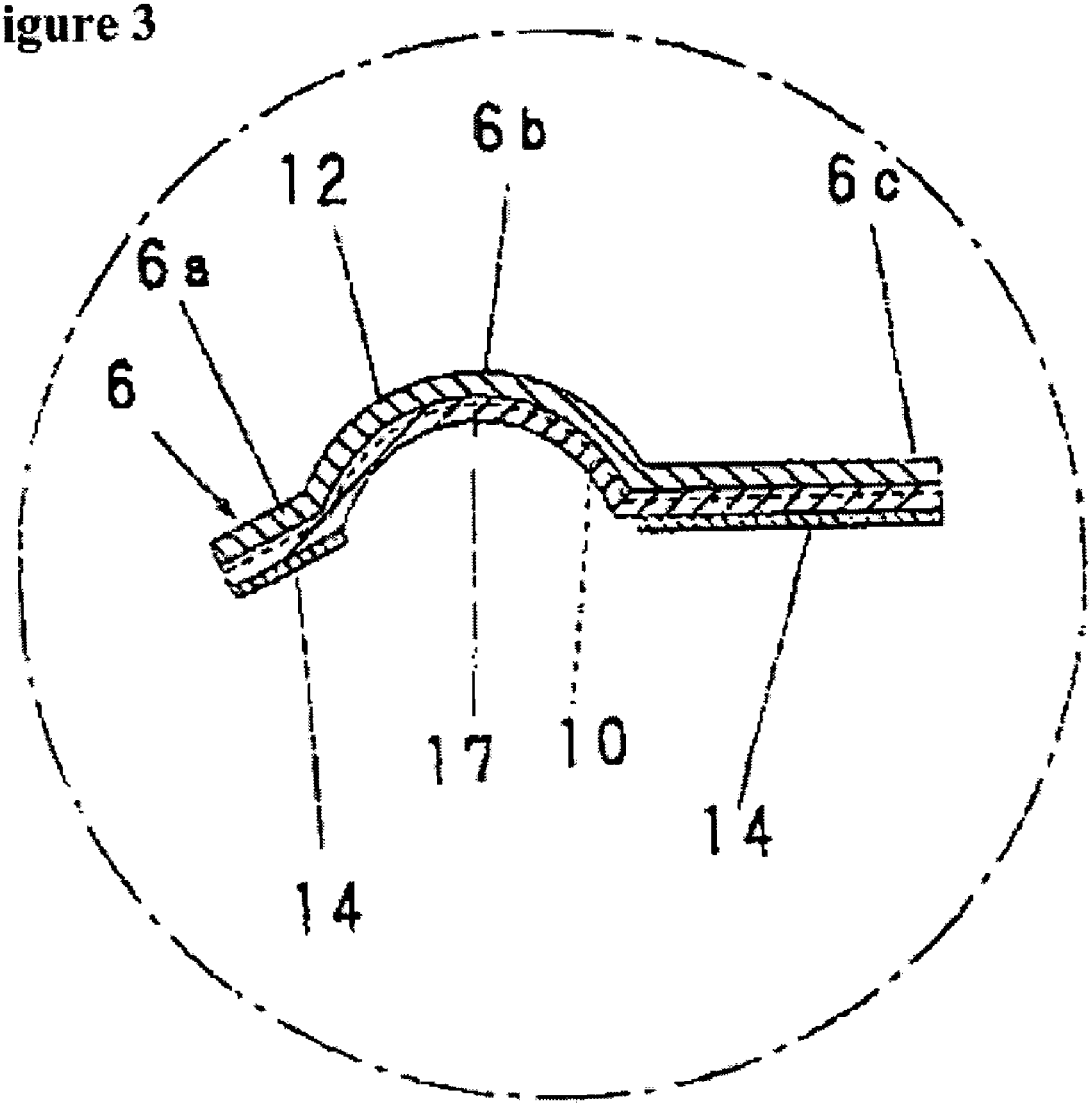
FIG. 3 is an enlarged cross-sectional view of the area enclosed within the circle indicated by the alternately long and short dashed line in FIG. 2, showing the structure of the present invention's speaker diaphragm edge.

The structure of Embodiment 1 of the present invention is shown in FIGS. 2 and 3. This embodiment is a diaphragm edge that is normally called a roll edge. The inner attachment margin 6*a* is formed at its interior, the flexible part 6*b* is formed in between, and the outer attachment margin 6*c* is formed at its exterior. As shown in the radial-direction cross-section in FIG. 3, the intermediate flexible part 6*b* is a circular arc that is convex at the front of the speaker. This region is a two-layer structure composed of the base fabric 10, the shaping agent layer 17 composed of a phenolic resin made flexible by blending in polyvinyl alcohol, and the surface coating agent layer 12 composed of a methacrylic resin elastomer that combines damping, weather resistance, airtightness, and waterproofing. Moreover, the hot-melt adhesive layer 14 is formed behind both the inner attachment margin 6*a* and the outer attachment margin 6*c*.

Figure 4:
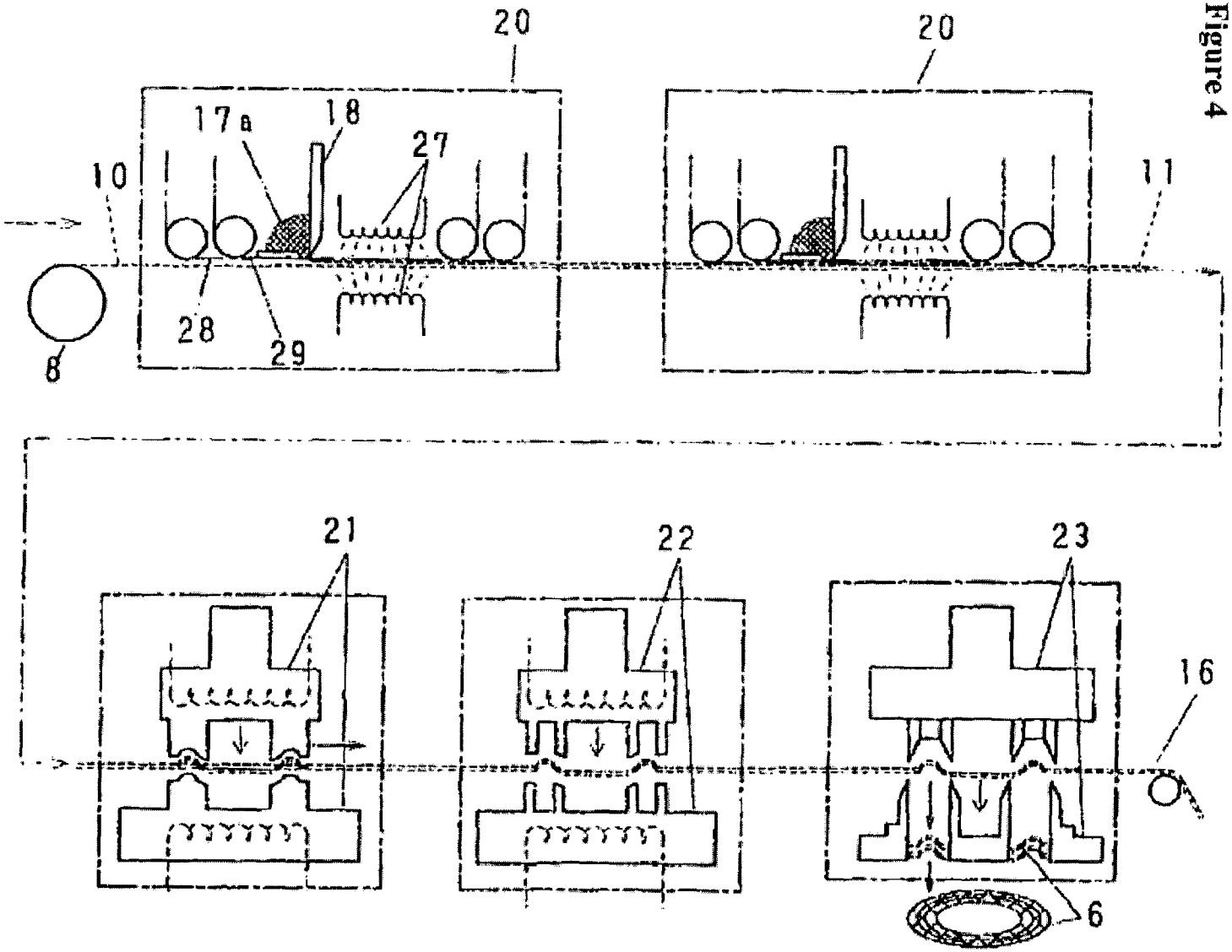
FIG. 4 is a schematic diagram showing the processes of the method of manufacturing a speaker diaphragm edge, which is Embodiment 2 of the present invention.
Figure 5:
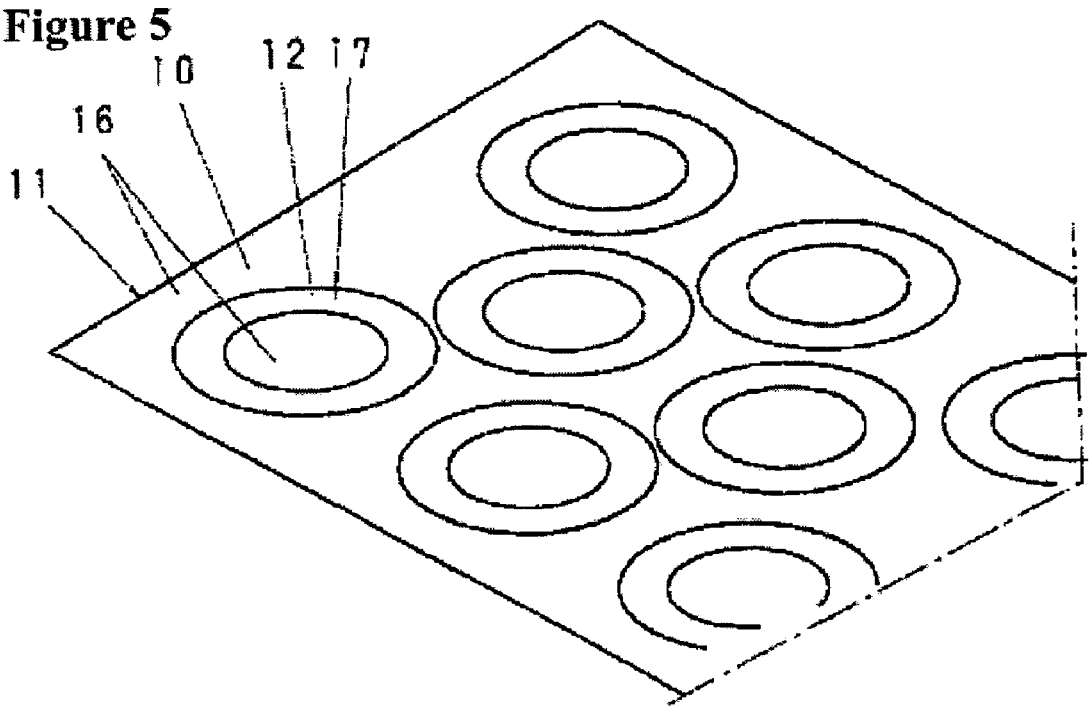
FIG. 5 is a schematic diagram showing the coating pattern on the resin-treated base material surface, in the process used to manufacture the speaker diaphragm edge of the present invention.

The configuration of Embodiment 2 of the present invention is shown in FIG. 4. This Embodiment 2 is the method used to manufacture the diaphragm edge 6 of the aforementioned Embodiment 1. In Embodiment 1, an 80-count 75×75 cotton woven fabric is used as the base fabric 10, which is extended from the winding spool 8 (which is easily stored, resists damage, and on which the base fabric 10 is rolled) onto the extension table, together with the silkscreen 28 and the mask 29, which are supplied endlessly. The phenolic resin 17*a*, which was softened by adding polyvinyl alcohol, was applied in a ring shape with the specified inner and outer diameters shown in FIG. 3, by means of a coater having the squeeze 18, for example, after which this was dried by means of the heater 27. The pattern used to print on the surface of the base fabric 10 is a staggered pattern, as shown in FIG. 5, to improve product yield. The coating unit 20 consists of a set of the means of supplying the silkscreen 28 and the mask 29, a coating means, and the heater 27 for drying. Normally, at least one or more sets of coating units 20 are slaved, according to the number of layers applied. In the case of this Embodiment 2, the diaphragm edge of Embodiment 1 has two layers, so a total of two sets are disposed, one for the shaping agent layer 17 and one for the surface coating agent layer 12. Next, the edge is shaped by means of the hot-stamping press 21, the hot-melt adhesive is applied to the specified locations by means of the applicator 22, thereby forming the hot-melt adhesive layer 14. Next, the punching mold 23 forms the diaphragm edges by punching them in a ring shape. The internal circular parts and the external parts are discarded as punching slugs 16.

Although examples of the deformation of this Embodiment 2 are not shown, if a manufacturing method that coats in one step by combining the shaping agent layer 17 and the surface coating agent layer 12 is adopted, it is possible to implement the aforementioned coating unit as only one set. In the case for elliptical diaphragm edges, for example, when attempting to improve speaker performance by further locally coating the edge of Embodiment 1 to locally vary the edge rigidity and by then controlling the vibration mode to improve speaker performance, deformation cases with three sets of coating units disposed also can be taken into consideration.

Figure 6:
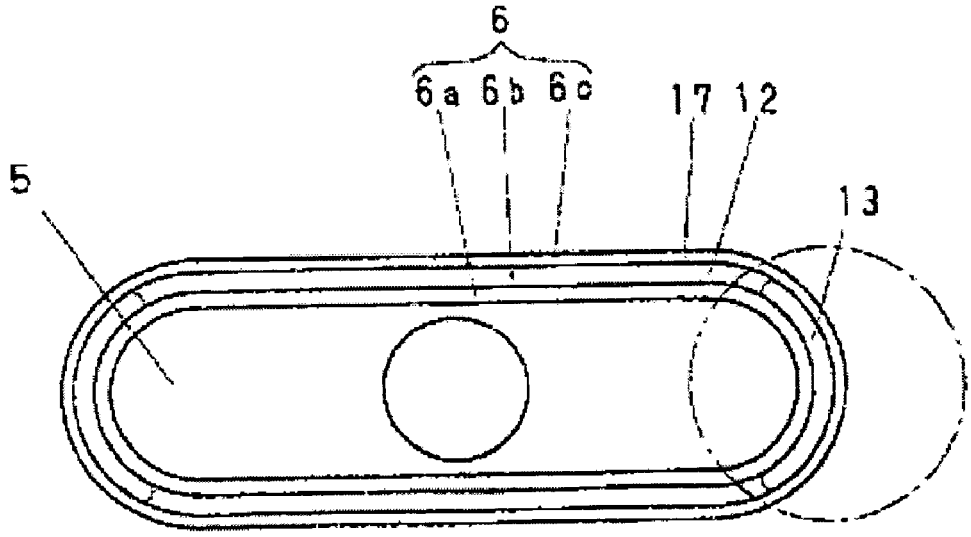
FIG. 6 is a top view showing the shape of the diaphragm edge of Embodiment 3 of the present invention.
Figure 7:
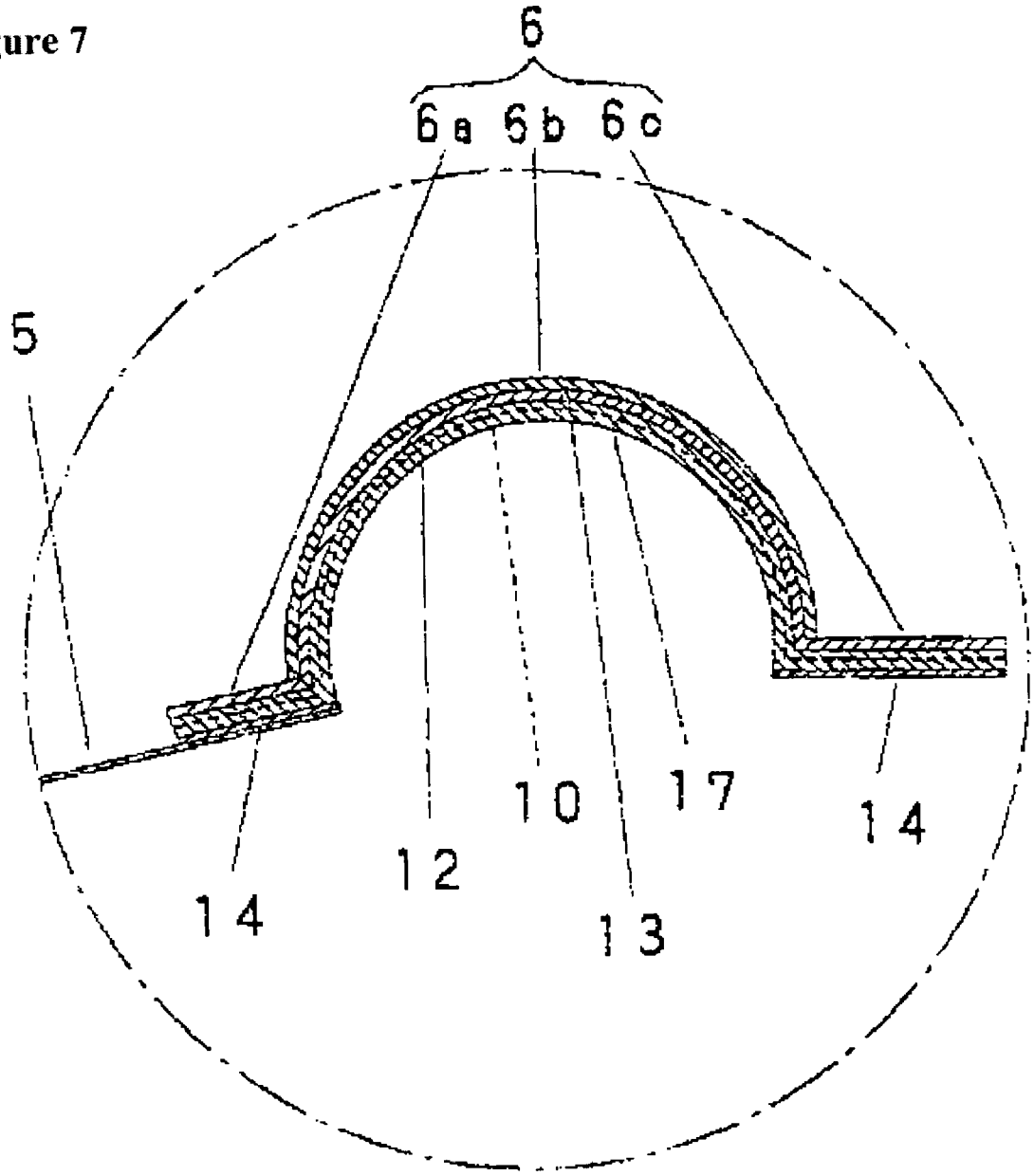
FIG. 7 is an enlarged cross-sectional view of the partial cross-section enclosed by the circle indicated by the alternately long and short dashed line in FIG. 6.

The diaphragm edge of Embodiment 3 is shown in FIGS. 6 and 7. As shown in FIG. 6, Embodiment 3, an elliptical diaphragm edge, is an edge with improved rigidity and resonance inhibition as the result of the formation of the resonance inhibition layer 13 in the edge region in the major-axis direction. An enlarged cross-section of the region in the major-axis direction is shown in FIG. 7. In this region, the edge has a three-layer structure composed of the shaping agent layer 17, the surface coating agent layer 12, and the resonance inhibitor layer 13. This edge is manufactured in a deformation case manufacturing facility in which are disposed three sets of coating units 20, which, as aforementioned, are not shown.

Embodiments considered representative of the present invention were explained previously, but the present invention is not necessarily limited to only the structures of these embodiments. It can be implemented after making the appropriate changes within the range such that is equipped with the aforementioned structural requirements of the present invention, it attains the purposes described in the present invention, and it has the effects described hereinafter.

As is evident from the previous explanation, the speaker diaphragm edge of the present invention is structured as described previously, and beginning with the shaping agent layer, coating agents with superior resonance inhibition and weather resistance are applied by means of the silkscreen printing technique, so even an elastic material, for example, can be applied as the base fabric material, and it is possible to coat only the ring-shaped required regions. Coating agents required for processing are used only in the required regions, so the amount used is at most one-third the conventional amount, thereby improving economy by reducing the materials costs. Also, this minimizes the unused regions of the coated material, which are treated as industrial waste. Most of the waste is uncoated and remains as raw fabric, which greatly reduces the environmental pollution problem. Moreover, coated layers are uniform, thereby improving product yield, which has the effect of significantly lowering production costs. Furthermore, the coloring of edge regions allows distinct coloring with various hues, which has the effect of enabling response to various demands.

Because coating agents are applied to the base fabric by means of the silkscreen printing technique, even when processing small lots it is possible to freely control not only the selection of the shaping agent layer and the coating agent but also the concentration and coating amounts. Moreover, the edge's physical shape and properties can be maintained easily, so it is possible to handle fine adjustments of playback sound quality in accordance with the speaker use, and when the shaping agent is flexible, the speaker demonstrates superior durability in response to continuous vibration. Furthermore, the coating agent layer is applied uniformly, so fluctuation in the speaker's fundamental resonant frequency ($f_0$) is minimal and stable, which contributes to improved speaker performance. Moreover, the resins that make up the shaping agent and the coating agent are those that react completely and have stable molecular structures, so there is no danger of pinhole generation. Therefore, there is little deterioration with age, which has the effect of maintaining stable quality for a long time.

Also, regarding the speaker diaphragm edge of the present invention, compliance change, correction, and modification can be performed easily for the resin materials, during processing steps. Also, the diaphragm edge's circumferential stiffness and resonance inhibition action can be changed locally as well as intentionally depending on the speaker application, so it became possible to expect effects that contribute to improved speaker performance and quality (e.g., the ability to make fine changes and adjustments of the speaker's frequency characteristics by performing such processes as the inhibition of diaphragm resonance and/or, conversely, the emphasis of resonance).

EXPLANATION OF THE SYMBOLS

1 Speaker
2 Magnetic circuit
2*a* Magnet
2*b* Toroidal magnetic gap
3 Voice coil
3*a* Voice coil bobbin
4 Damper
5 Diaphragm
6 Diaphragm edge
6*a* Inner attachment margin
6*b* Flexible part
6*c* Outer attachment margin
7 Frame
8 Winding spool
10 Base fabric
11 Resin-treated base material
12 Surface coating agent layer
13 Resonance inhibitor layer
14 Hot-melt adhesive layer
16 Punching slug
17 Shaping agent layer
18 Squeeze
20, 20 Coating units
21 Hot-stamping press
22 Applicator
23 Punching mold
27 Heater
28 Silkscreen
29 Mask

The invention claimed is:

1. A method of forming an edge of a speaker diaphragm comprising:

providing a plurality of successively disposed sections;

a first forming step of forming, in a first of said plurality of process sections, a resin-treated base fabric from a base fabric by applying a silkscreen printing technique for depositing a shaping agent layer to a necessary portion of said base fabric;

a second forming step of forming, in a second of said plurality of process sections, a surface coating agent layer on said base fabric for improving physical functionality of said diaphragm edge;

hot-forming said base fabric into a desired edge shape;

a third forming step of forming, in a third of said plurality of process sections, a hot-melt adhesive layer on said base fabric onto an area of bonding between said diaphragm and a frame; and said first, second and third forming steps each separately heating said shaping agent layer, said coating agent layer and said hot-melt adhesive layer, respectively.

2. The speaker diaphragm edges described in claim 1, such that the shaping agent layer is formed by using a phenolic resin.

3. The speaker diaphragm edges described in claim 1, such that the shaping agent layer is formed by using a phenolic resin composite whose coatability was improved by blending a polyvinyl alcohol resin into the phenolic resin.

4. The speaker diaphragm edges described in claim 1, such that the shaping agent layer is formed by using a phenolic resin composite whose coatability was improved by blending an alcohol other than polyvinyl alcohol resin into the phenolic resin.

5. The speaker diaphragm edges described in claim 1, such that the shaping agent layer is formed by using a thermosetting synthetic resin.

6. The speaker diaphragm edges described in any one of the proceeding claims, such that either or both the shaping agent layer and the surface coating agent layer are formed by using a material colored by means of a dye or pigment, and the surface coating agent layer is formed from material selected from a group consisting of rubber emulsion dye and methacrylic dye.

7. A speaker diaphragm edge manufacturing method in which a resin-treated base material is formed by using a silkscreen printing technique to apply a shaping agent only to the necessary portion of a base fabric, thereby forming the shaping agent layer; followed by a step whereby the aforementioned resin-treated base material is hot-formed into a specified shape; a step whereby a surface coating agent layer is applied and formed at desired locations on said material; followed by a step whereby a hot-melt adhesive is applied to an area of bonding between a peripheral diaphragm and a frame from among an edge material within a base material which has been once again hot-formed into shape; and lastly a step whereby the coated base material after being coated is cut into rings corresponding to the circumferential shapes of the desired diaphragms.

* * * * *